US008365816B2

(12) United States Patent
Havinga

(10) Patent No.: US 8,365,816 B2
(45) **Date of Patent: *Feb. 5, 2013**

(54) METHOD AND APPARATUS FOR CONDUCTING EARTH BOREHOLE OPERATIONS

(75) Inventor: Richard Havinga, Oktoks (CA)

(73) Assignee: Xtreme Drilling and Coil Services Corp., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/346,934

(22) Filed: Jan. 10, 2012

(65) Prior Publication Data

US 2012/0103632 A1 May 3, 2012

Related U.S. Application Data

(63) Continuation of application No. 11/294,163, filed on Dec. 5, 2005.

(51) Int. Cl.
*E21B 19/22* (2006.01)
*E21B 19/18* (2006.01)

(52) U.S. Cl. ..... 166/77.52; 166/77.2; 166/77.4; 166/382

(58) Field of Classification Search ..... 166/77.2, 166/77.4, 382, 77.52; 414/419
See application file for complete search history.

(56) References Cited

U.S. PATENT DOCUMENTS 3,857,450 A * 12/1974 Guier ..... 175/85
4,117,941 A * 10/1978 McCleskey, Jr. et al. .. 414/22.63
6,273,188 B1 * 8/2001 McCafferty et al. ..... 166/77.2

* cited by examiner

*Primary Examiner* — Cathleen Hutchins

(74) *Attorney, Agent, or Firm* — Bushman & Associates, P.C.

(57) ABSTRACT

A method and apparatus for conducting earth borehole operations comprising a CT system comprising a first carrier with a reel of CT and a CT injector, a second carrier comprising a top drive rig having a mast, and a lifter operative to move the CT injector from the first carrier to an operative or near operative position with respect to the mast on the second carrier.

9 Claims, 10 Drawing Sheets

FIG. 13
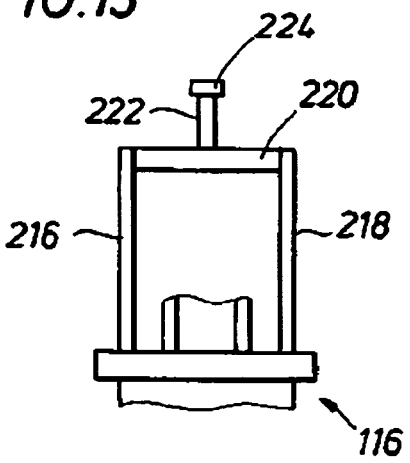
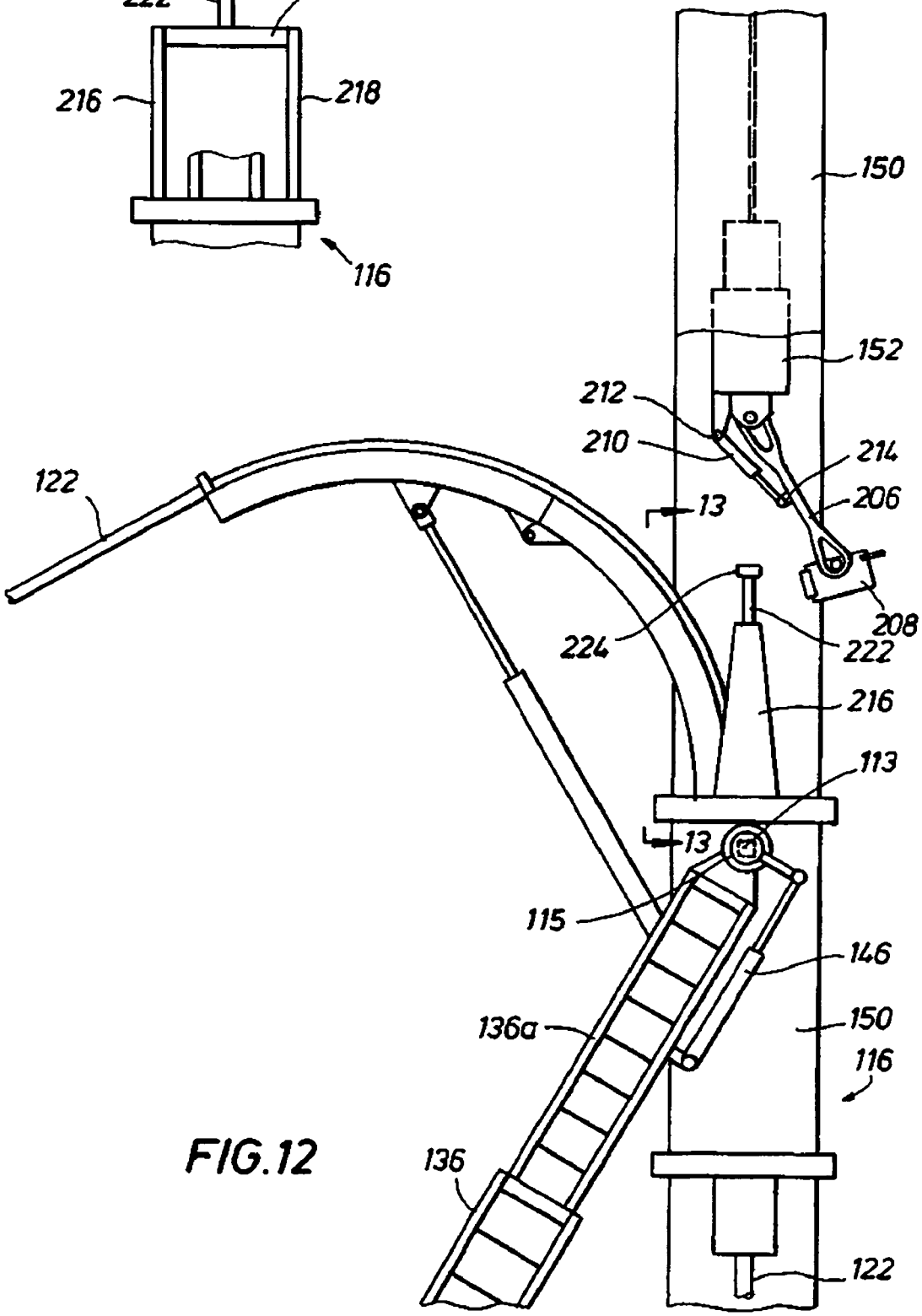
FIG. 12

METHOD AND APPARATUS FOR CONDUCTING EARTH BOREHOLE OPERATIONS

CROSS REFERENCE TO RELATED APPLICATION

This application is a continuation of U.S. Non-provisional application Ser. No. 11/294,163 filed Dec. 5, 2005, the disclosure of which is incorporated herein by reference for all purposes.

BACKGROUND OF THE INVENTION

1. Field of the Invention

The present invention relates to a method and apparatus for performing earth borehole operations and, in particular, to an apparatus and method which can use both coiled tubing and jointed (threaded) pipe.

2. Description of Prior Art

The use of coiled tubing (CT) technology in oil and gas drilling and servicing has become more and more common in the last few years. In CT technology, a continuous pipe wound on a spool is straightened and insulated into a well using a CT injector. CT technology can be used for both drilling and servicing, e.g., workovers.

The advantages offered by the use of CT technology, including economy of time and cost are well known. As compared with jointed-pipe technology wherein typically 30-45 foot straight sections of pipe are threadedly connected one section at a time while drilling the wellbore, CT technology allows the continuous deployment of pipe while drilling the well, significantly reducing the frequency with which such drilling must be suspended to allow additional sections of pipe to be connected. This results in less connection time, and as a result, an efficiency of both cost and time.

However, the adoption of CT technology in drilling has been less widespread than originally anticipated as a result of certain problems inherent in using CT in a drilling application. For example, because CT tends to be less robust than jointed-pipe for surface-level drilling, it is often necessary to drill a surface hole using jointed-pipe, cement casing into the surface hole, and then switch over to CT drilling. Additionally, when difficult formations such as gravel are encountered down-hole, it may be necessary to switch from CT drilling to jointed-pipe drilling until drilling through the formation is complete, and then switch back to CT drilling to continue drilling the well. Similarly, when it is necessary to perform drill stem testing to assess conditions downhole, it may again be necessary to switch from CT drilling to jointed-pipe drilling and then back again. Finally, a switch back to jointed pipe operations is necessary to run casing into the drilled well. In short, in CT drilling operations it is generally necessary for customers and crew to switch back and forth between a CT drilling rig and a jointed-pipe conventional drilling rig, a process which results in significant down-time as one rig is moved out of the way, and the other rig put in place.

Another disadvantage of CT drilling is the time consuming process of assembling a (bottom-hole-assembly (BHA)—the components at the end of the CT for drilling, testing, well servicing, etc.), and connecting the BHA to the end of the CT. Presently, this step is performed manually through the use of rotary tables and make-up/breakout equipment. In some instances, top drives are used but the CT injector and the top drive must be moved out of each others way, i.e., they cannot both be in line with the borehole. Not only does this process result in costly downtime, but it can also present safety hazards to the workers as they are required to manipulate heavy components manually.

To address the problems above associated with the use of CT technology and provide for selective and rapid switching from the use of a CT injector to a top drive operation, certain so-called "universal" or "hybrid" rigs have been developed. Typical examples of the universal rigs, i.e., a rig which utilizes a single mast to perform both top drive and CT operations, the top drive and the CT injector being generally at all times operatively connected to the mast, are shown in United States Patent Publication 2004/0206551; and U.S. Pat. Nos. 6,003,598, and 6,609,565. Thus, in U.S. Publication 2004/0206551 there is disclosed a rig adapted to perform earth borehole operations using both CT and/or jointed-pipes, the CT injector and a top drive being mounted on the same mast, the CT injector being selectively moveable between a first position wherein the CT injector is in line with the mast of the rig and hence the earth borehole and a second position wherein the CT injector is out of line with the mast and hence the earth borehole.

In all the systems disclosed in the aforementioned patents, the top drive and the CT injector are two separate units. Accordingly, as disclosed in all of the aforementioned patents, various techniques are disclosed for selectively positioning the CT injector or the top drive over center of the wellbore depending on whether CT operations are being conducted or jointed pipe operations are being conducted. Additionally, in all of the systems disclosed in the aforementioned patents, and as noted, the top drive and the CT injector are at all times operatively connected to the mast. There are occasions when it would be desirable to have the convenience of only top drive operations without the added complication of a CT injector being connected to the mast which carries the top drive. Furthermore, it would be desirable to have a system which could rapidly switch between CT operations and top drive operations and wherein a single CT injector system could be selectively, operatively associated with a rig carrying only a top drive (top drive rig) such that the single CT injector system could be transferred from one top drive rig to another top drive rig as convenience and necessity dictated.

SUMMARY OF THE INVENTION

In one embodiment of the present invention there is provided a method of conducting earth borehole operations, e.g., drilling. The method includes providing a CT system comprising a first carrier, a CT injector and a reel of CT mounted on the first carrier and providing a second carrier, separate from the first carrier, a mast being mounted on the second carrier, a top drive being carried by the mast for longitudinal movement there along. The method further includes providing a lifter and moving the CT injector with the lifter from the first carrier to a position whereby the CT injector is in line with the top drive and can be suspended from one of the mast or the top drive. Further, the method includes suspending the CT injector from one of the mast or the top drive and interconnecting the mast and the CT injector to prevent reactive movement of the CT injector relative to the mast. The method also comprises conducting an operation in the wellbore, the operation comprising feeding CT from the reel through the CT injector into the wellbore, at least a portion of the weight of the CT injector and at least a portion of the weight of CT in the wellbore being carried by the mast as transferred from the top drive.

In another aspect of the present invention, there is provided an apparatus for conducting earth borehole operations, the apparatus comprising a CT system comprising a first carrier, a CT injector and a reel of CT carried on the first carrier. There is also a second carrier, separate from the first carrier. A mast is mounted on the second carrier and a top drive is carried by the mast for longitudinal movement therealong. There is a lifter to move the CT injector from the first carrier to a position whereby the CT injector in line with the top drive is suspended from one of the mast or the top drive. A torque arrester interconnects the mast and the CT injector to prevent reactive movement of the CT injector relative to the mast.

BRIEF DESCRIPTION OF THE DRAWINGS

FIG. 12 is a view similar to FIG. 11 but showing the CT injector positioned below the top drive prior to being suspended from the top drive.

FIG. 13 is an elevational view taken along the lines 13-13 of FIG. 12.

DETAILED DESCRIPTION OF PREFERRED EMBODIMENTS

Figure 2:
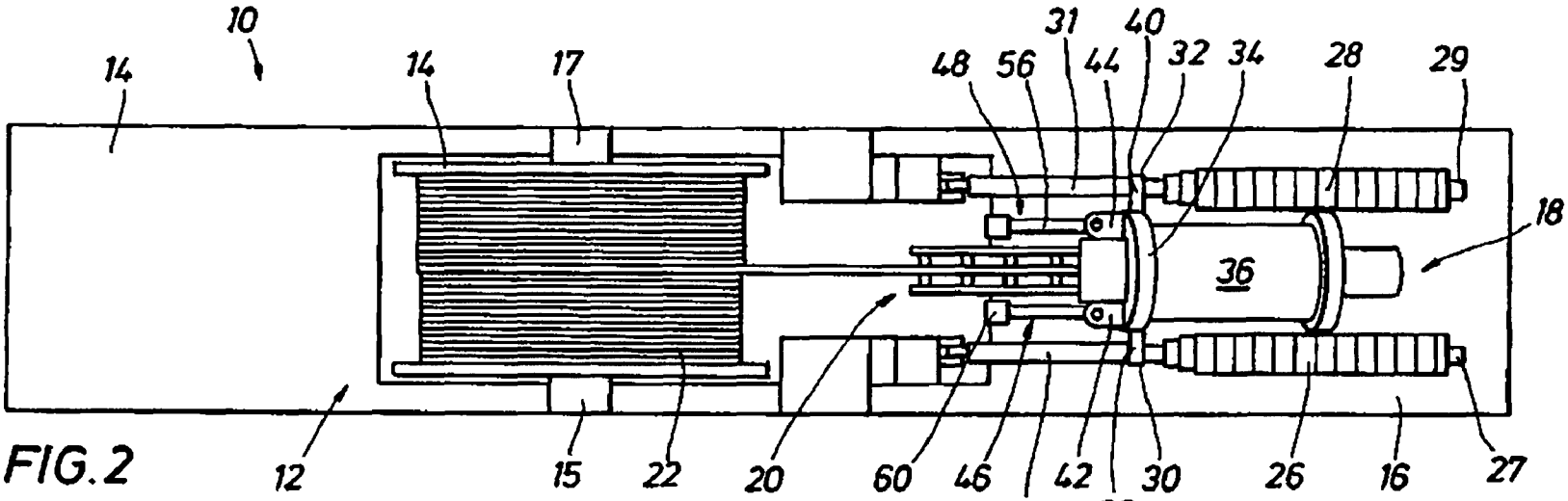
FIG. 2 is a top, plan view of the CT system shown in FIG. 1.
Figure 1:
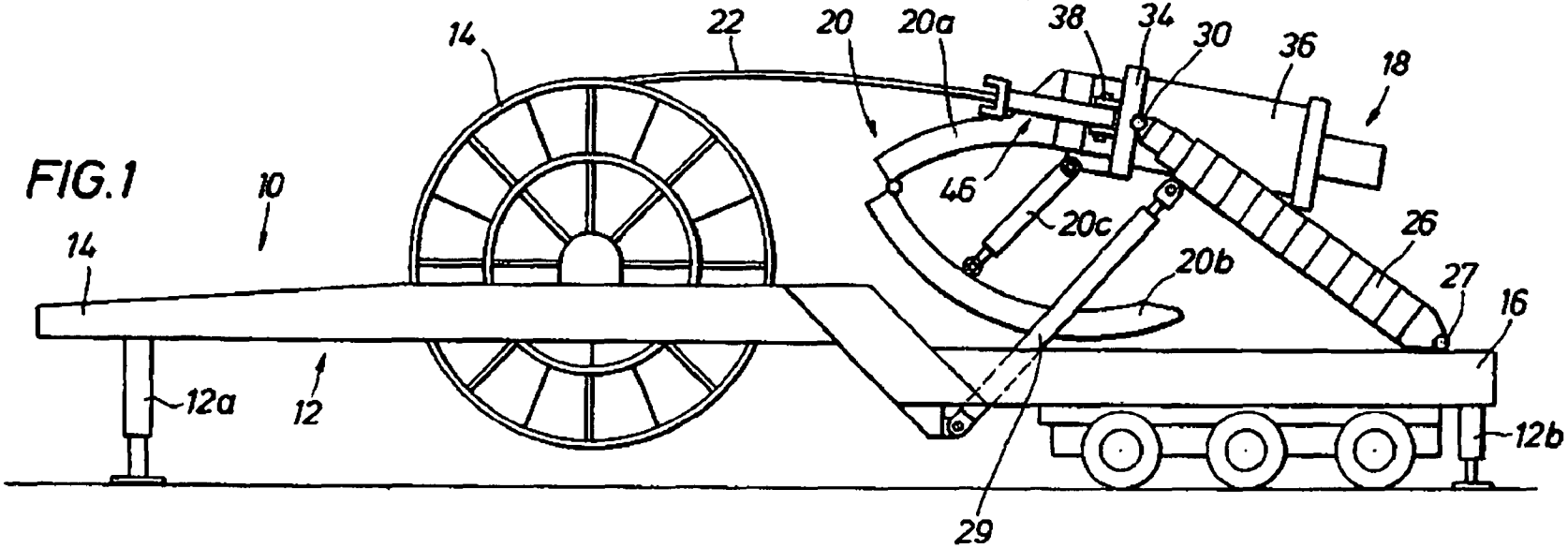
FIG. 1 is a side, elevational view of a CT system for use in the present invention.

Referring first to FIGS. 1 and 2, there is shown a CT system indicated generally as 10. CT system 10 comprises a trailer 12 which as shown is of the wheeled variety having a tongue 14 for attachment to a tractor or the like so that the trailer 12 can be moved as desired. Outriggers 12*a* and 12*b* provide stability to trailer 12 when trailer 12 is positioned for use. Rotatably mounted in pillow blocks 15 and 17 on trailer 12 is a reel 14 of CT. Trailer 12 also includes a sub-platform 16 upon which rest a CT injector shown generally as 18. As is well known, CT injector 18 is associated with a guide or gooseneck 20 which guides CT 22 being played off of CT reel 14 into CT injector 18. As shown, CT 22 has been stabbed into CT injector 18. As also seen, guide 20 is comprised of two sections 20*a* and 20*b* which are secured together by a hinge 24. A piston/cylinder combination 20*c* interconnects CT injector 18 and guide section 20*b* for a purpose to be described hereafter. Also pivotally mounted as at 27 and 29 on subplatform 16 are a pair of booms 26 and 28, booms 26 and 28 being of a telescoping variety and, as shown, are comprised of three telescoping sections. As seen in FIGS. 1 and 2, connected between carrier 12 and booms 26 and 28 are piston/cylinder combinations 29 and 31, respectively, which can be actuated by a hydraulic system not shown but well know to those skilled in the art.

A frame comprising a collar 34 is secured to and encircles the housing 36 of CT injector 18. Collar 34 is provided with first and second ears 38 and 40 which extend laterally outwardly on generally, diametrically opposite sides of collar 34. Booms 26 and 28 are pivotally secured by means of connections 30 and 32 to ears 38 and 40, respectively. Collar 34 is also provided with a pair of pillow blocks 42 and 44 which serve to rotatably journal a pair of fork members 46 and 48, respectively, fork member 46 comprising an arm 50 terminating is attached to a head portion comprised of first and second spaced tines 52 and 54. In like fashion, fork member 48 comprises an arm 56 attached to a head portion comprised of spaced tine members 58 and 60 (see FIG. 5).

Figures 4, 5:
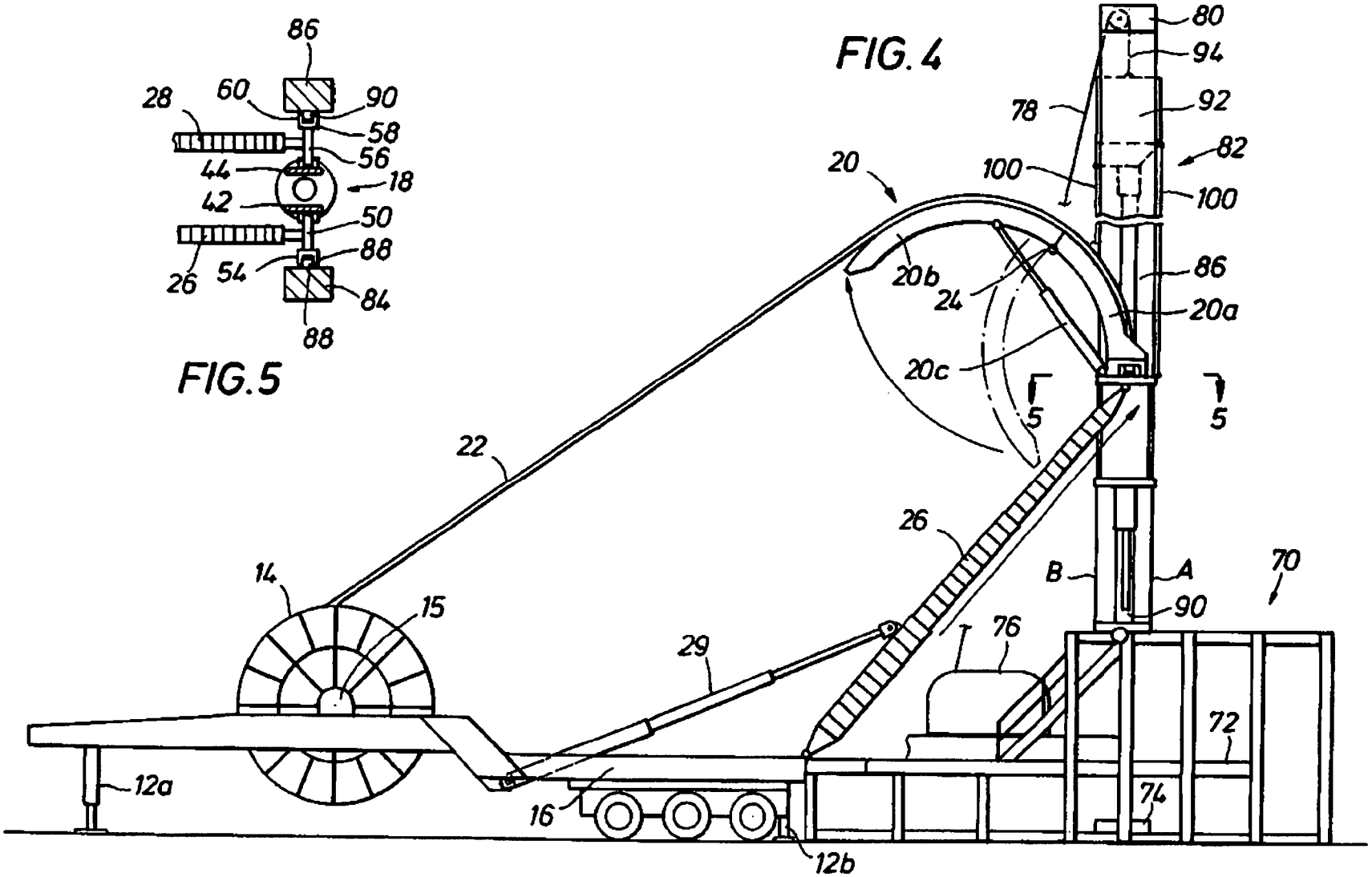
FIG. 4 is a side, elevational view showing the CT injector of the CT system of FIG. 1 being moved to a position in the top drive rig to perform CT operations.
FIG. 5 is a view, partly in section, taken along the lines 5-5 of FIG. 4.

Turning now to FIGS. 4 and 5, there is shown a second carrier indicated generally at 70. As shown, carrier 70 is comprised of a framework including a platform 72 which is positioned over a wellhead 74 of a wellbore not shown. Mounted on platform 72 is a drawworks 76 with a cable 78 extending up to a crown block 80 mounted on a mast 82. In the embodiment shown, mast 82 is comprised of first and second, spaced columns 84 and 86. Extending longitudinally along and attached to column 84 is rail 88 while a rail 90 is attached to and extends longitudinally along column 86. While mast 82 is shown as being formed primarily by two columns, it will be understood that this is for simplicity purposes only and that mast 82 can take various structured forms. Movably, e.g., slidably, mounted for longitudinal movement along mast 82 is a top drive 92, top drive 92 being slidably engaged with rails 88 and 90 and being moved by cables 94 running from crown block 80. The carrier 70 with mast 82 is referred to herein as a top drive rig.

As can be seen with reference to FIG. 4, CT injector 18 is in an operative position, i.e., in a position to conduct CT operations in the wellbore below wellhead 74. To accomplish this, and again with reference to FIG. 1, the piston/cylinder combinations 29 and 31 are activated to move booms 26 and 28 to the position shown in FIG. 4. Booms 26 and 28 as noted above are of the telescoping variety whereby the sections of booms 26 and 28 can by hydraulic or mechanical means well known to those skilled in the art, be extended to the position shown in FIG. 4. Thus, by virtue of the pivotal movement of booms 26 and 28 from the position shown in FIG. 1 by mean of piston/cylinder combinations 29 and 31 together with the extension of the telescoping sections of booms 26 and 28, the CT injector 18 is moved from first carrier 12 to second carrier 70 in an operative position. Also, piston/cylinder combination 20*c* has been activated to move section 20*b* of guide 20 to the portion shown in FIG. 4 such that a complete guide arc has been formed. It should be noted that while second carrier 70 is shown as a fixed structure, it could comprise a wheeled structure and in this regard the word "carrier" is intended to include any support, platform, skid, or any structure whether fixed, wheeled or self-propelled.

As seen with particular reference to FIG. 4, once CT injector 18 is positioned as shown in FIG. 4, i.e., such that CT injector is in line with top drive 92 and CT 22 issuing therefrom is substantially in line with wellhead 74 and hence the wellbore therebelow, cables 100 which extend from top drive 92 are connected to CT injector 18 such that CT 18 is now suspended from top drive 92. In this position, CT injector 18 and top drive 92 are substantially in line with one another as well as wellhead 74. It will also be appreciated that in this position top drive 92 effectively serves as an elevator for CT injector 18 such that it could be moved longitudinally along mast 82. To this end, once CT injector 18 has been positioned as shown in FIG. 4, such that it is essentially in line with top drive 92, and cables 100 are attached so that CT 18 is now suspended from top drive 92, fork members 46 and 48 are now moved from the position shown in FIG. 1, i.e., where they are substantially parallel or at least running lengthwise of CT injector 18 to the position shown in FIG. 5 where they are now transverse to the long axis of CT injector 18 and hence transverse to mast 82. When moved to this position, rail 88 will be received between tines 52 and 54 while rail 90 will be received between tines 58 and 60. This movement of fork members 46 and 48 can be accomplished mechanically, hydraulically or indeed manually if desired. It will now be seen that CT injector 18 can now be moved longitudinally along mast 82 by virtue of engagement of the fork members 46 and 48 with the rails 88 and 90, respectively. It will also be understood that fork members 46 and 48 can be releasably locked into the position shown in FIG. 5 by mechanisms well known to those skilled in the art. While the fork members 46 and 48 are shown as being pivotally attached to CT injector 18, it will be appreciated that the fork members could be in the form of a piston/cylinder or telescopic form such that in the retracted position the fork members would be out of engagement with the rails 88 and 90 but when in the extended position the rails would be received between the tines of the respective fork members. It will also be appreciated that other forms of engagement members can be employed to selectively, releasably provide an operative connection between the rails 88, 90 and CT injector 18.

Figures 3, 14:
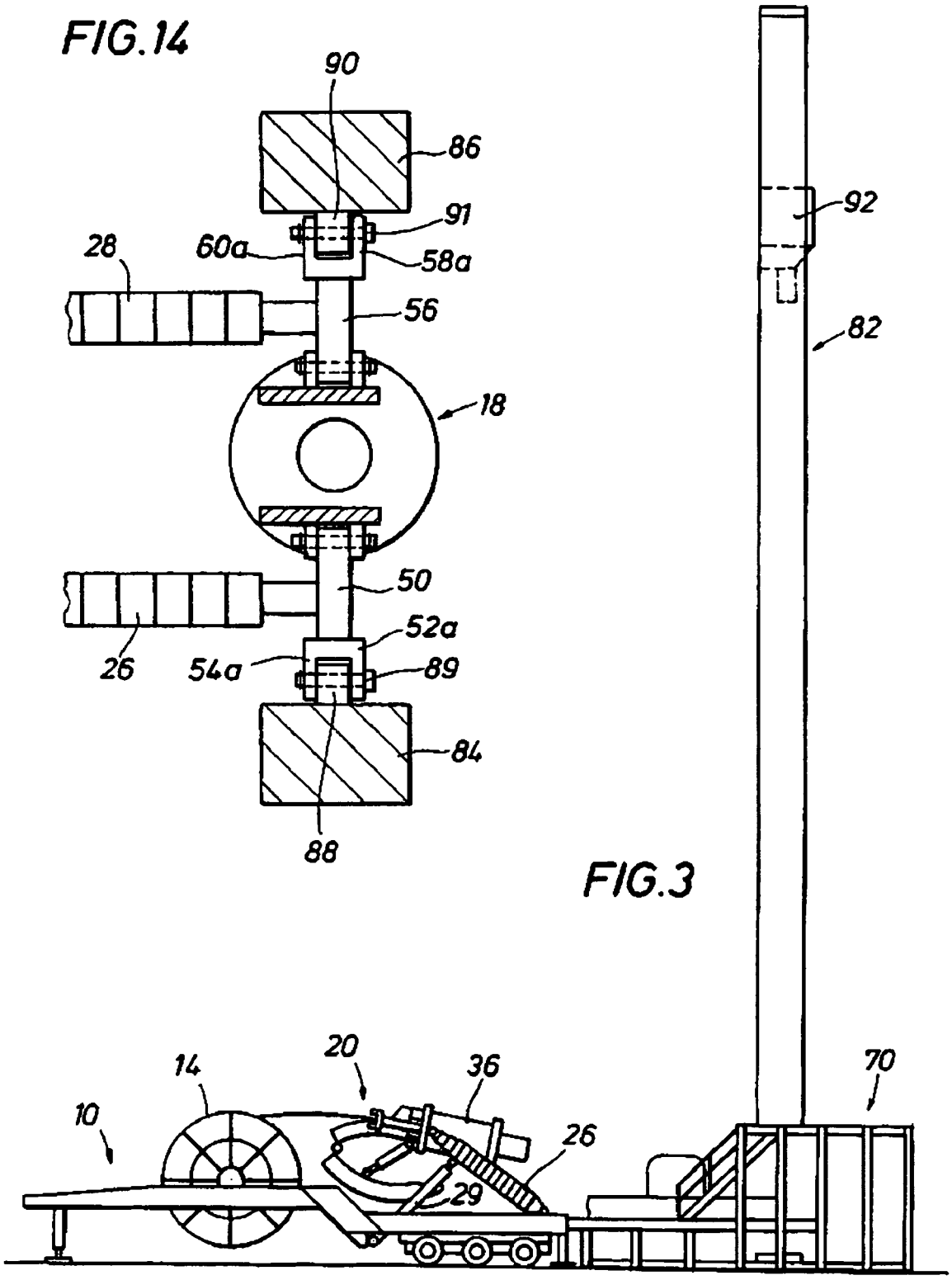
FIG. 3 is a side, elevational view of the CT system of FIG. 1 adjacent a top drive rig.
FIG. 14 is an enlarged view similar to FIG. 5 showing one technique for suspending the CT injector from the mast as opposed to the top drive.

This selectively, releasable engagement of CT injector 18 to rails 88 and 90, along with permitting CT injector 18 to move in a guided manner along mast 82, serves the important purpose of curtailing any tendency CT injector 18 would have to pivot in the directions of arrows A or B as a reaction to forces applied to CT 22 by guide 20 when, for example, CT 22 was being injected into or retrieved from the wellbore. Accordingly, fork members 46 and 48 in conjunction with rails 88 and 90 serve as torque arresters or curtailers since they arrest, indeed substantially prevent, any pivotal movement of CT injector 18 around an imaginary axis passing between columns 84 and 86 forming mast 82. FIGS. 4 and 5 depict the situation where the CT injector 18 has been moved to an operative position in mast 82, i.e., off of carrier 12. FIG. 3 depicts the condition wherein carrier 10 has been backed up to carrier 70 and prior to any movement of CT injector 18 off of carrier 10 and into the position shown in FIG. 4. It will be appreciated that in the view depicted in FIG. 3, top drive 92 can conduct jointed pipe operations since CT injector 18 is not suspended from top drive 92 and accordingly does not interfere with the ability of top drive 92 to run in or trip out jointed pipe from the wellbore below wellhead 74.

Figure 6:
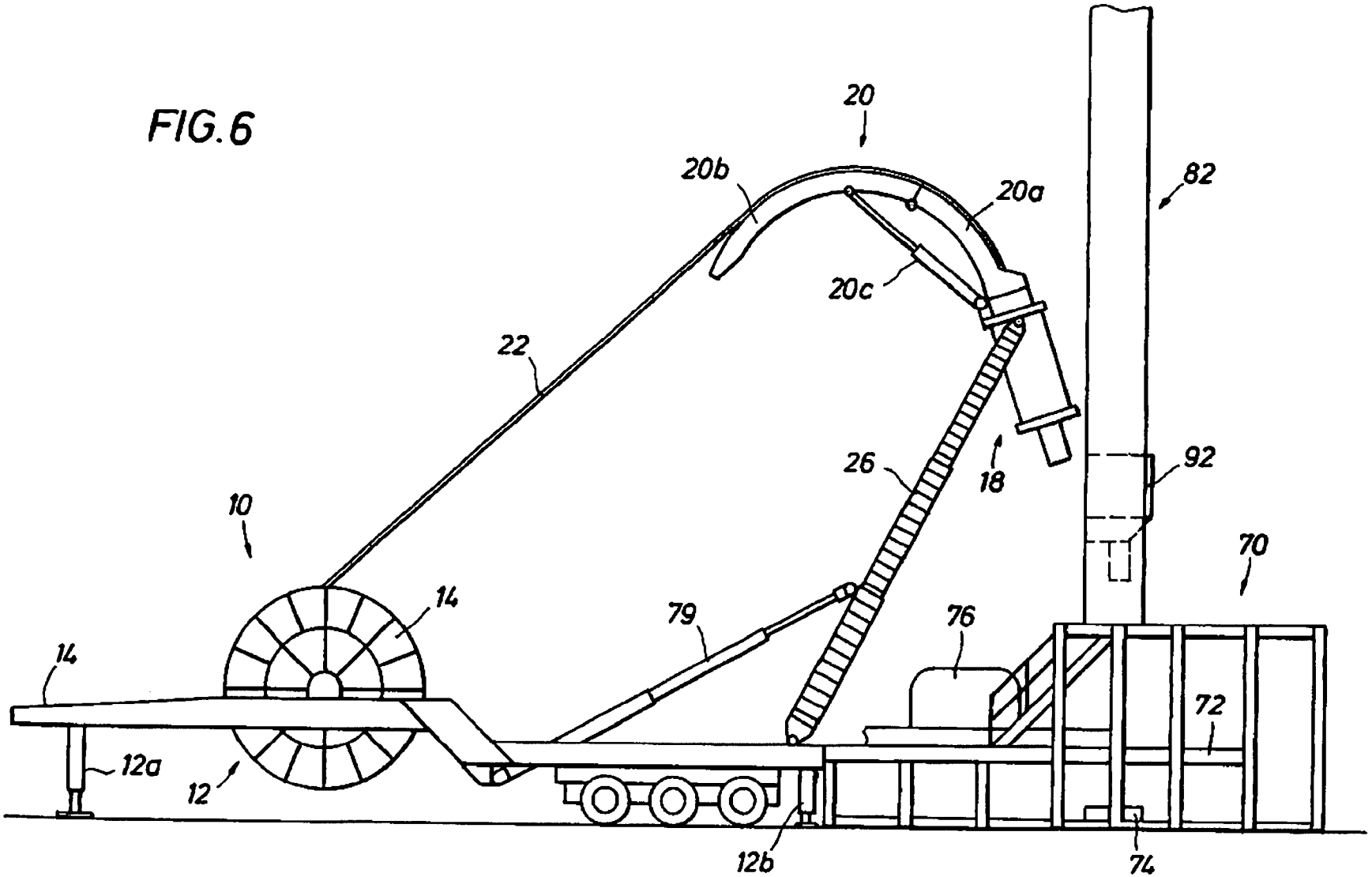
FIG. 6 is a side elevational view, similar to FIG. 4 but showing the CT injector being moved from the position shown in FIG. 4 to a position wherein top drive operations can be performed by the top drive rig.

Turning now to FIG. 6, there is depicted a condition wherein CT injector 18 has been moved from the position shown in FIG. 4 to a position wherein CT injector 18 has been detached from top drive 92. As seen, CT injector 18 has been moved laterally away from mast 82 such that it does not interfere with the operation of top drive 92 or its longitudinal movement along the length of the rails 88, 90. In the position shown in FIG. 6, once operations using top drive 92 have been completed, top drive 92 can then be moved upwardly in mast 82, CT injector 18 moved into position shown in FIG. 4 and again suspended via cables 100 from top drive 92 and once again commence performing CT operations. It will thus be seen that the invention provides a rapid way to convert from jointed pipe operations using top drive 92 to CT operations using CT injector 18 and vice versa. Furthermore, it will be appreciated that since carrier 12 and carrier 70 are separate from one another, if protracted top drive operations are contemplated, the CT system can be moved to another site to perform CT operations using another top drive rig.

Figure 7:
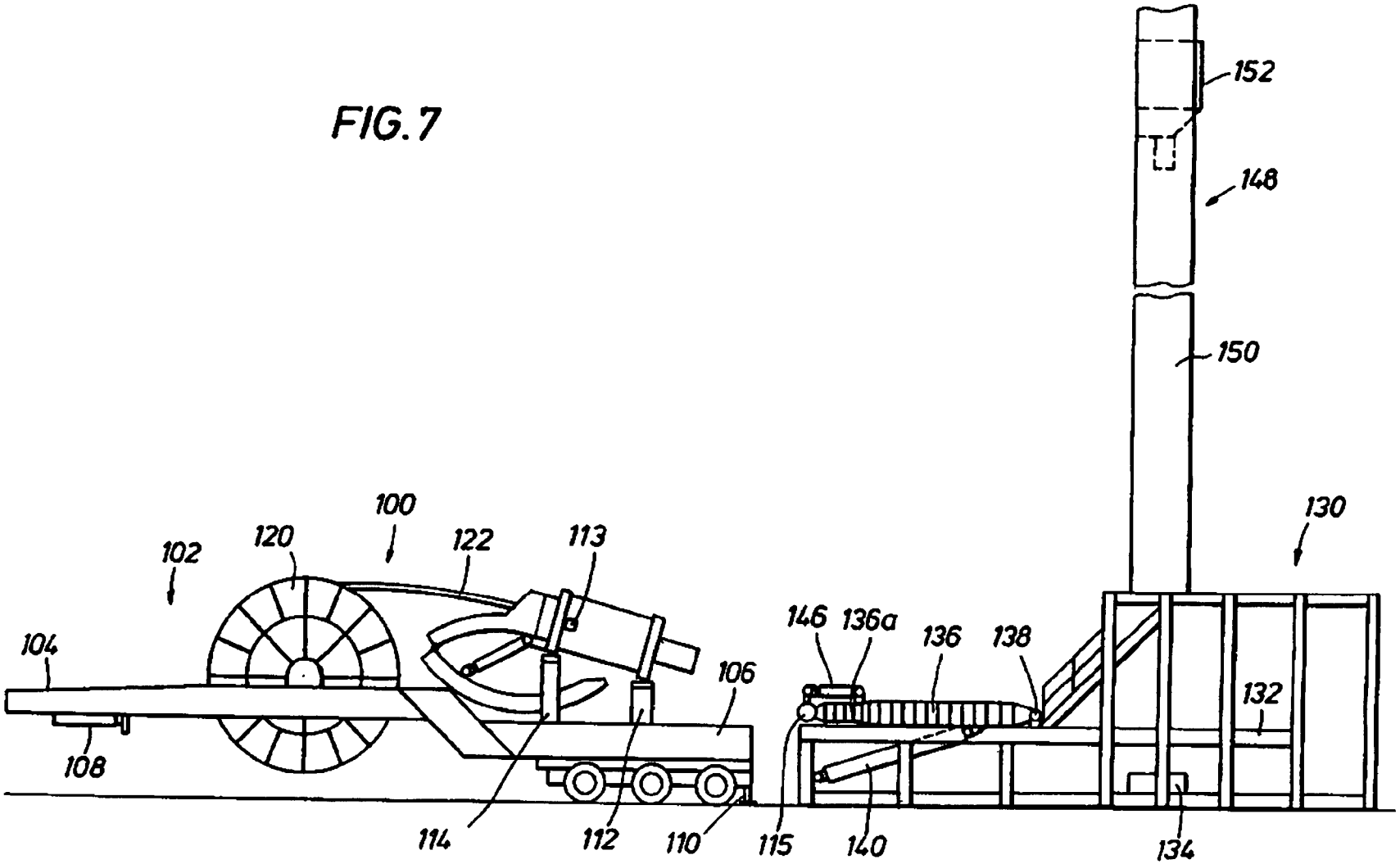
FIG. 7 is a side elevational view of another embodiment of the present invention showing a top drive rig with a lifter mounted thereon for moving a CT injector from a CT system.

Referring now to FIG. 7, there is shown another embodiment of the present invention wherein the lifter to move the CT injector off of its carrier and into an operative position in the mast which carries the top drive is mounted on the carrier for the mast rather than on the carrier for the CT. The CT injector system 100 like CT injector system 10 comprises a carrier 102 which, as shown is in the form of a wheeled trailer having a tongue 104 for attachment to a tractor or the like for transport. As in the case of carrier 12, carrier 102 is provided with outriggers 108 and 110 to stabilize carrier 102 when in position for use.

A pair of support stanchions 112 and 114 extend upward from a platform 106 on carrier 102 and form a rest or cradle for a CT injector shown generally as 116. In large part, CT injector 116 is similar to CT injector 18. In this regard, although not shown, CT injector 116 is provided with a frame including a collar such as collar 34, a guide or gooseneck, a piston/cylinder arrangement such as cylinder 20*c*, as well as fork members such as fork members 46 and 48, all for the same purpose as described above with respect to CT injector 18. Rotatably journaled in suitable pillow blocks 118, only one of which is shown, is a reel 120 of CT 122, CT 122 extending from reel 120 to CT injector 116.

In the embodiment shown in FIG. 7, second carrier 130 is similar in many respects to carrier 70 in that there is a framework including a platform 132 on which is mounted but not shown a drawworks such as drawworks 76 as seen in FIG. 4. Carrier 130 is positioned over a wellhead 134 below which is a wellbore not shown. Attached to platform 132 or to any suitable structural member forming the framework of carrier 130, are a pair of telescopic booms 134 only one of which is shown. Telescopic booms 136 are pivotally attached as at 138 to platform 132 or, as noted, to a suitable structural member forming carrier 130.

Piston/cylinder combinations 140, only one of which is shown, are pivotally attached as at 142 to the framework forming carrier 130 and also pivotally attached as at 144 to boom 136. Again, although not shown it will be understood that there are two booms 136, both of which are attached to carrier 130 in the manner described above with respect to boom 136. A pair of posts 113, only one of which is shown, are fixed to and extend outwardly from the opposite sides of CT injector 116. Posts 113 have non-circular ends, e.g., wrench flats, distal the CT injector 116. Carried on the ends of the telescoping sections 136*a* of booms 136 which are most distal from pivot connection points 138 are selectively releasable wrenches 115, only one of which is shown. Wrenches 115 have a profile which matches the non-circular end profiles of posts 113. Also, wrenches 115 are rotatable relative to sections 136*a*. Accordingly when wrenches 115 engage posts 113 there is no relative movement therebetween. Additionally, telescoping sections 136*a* of booms 136 carry piston/cylinder combinations 146 which connect between the telescoping sections 136*a* and wrenches 115. When telescoping booms 136 are moved to the position shown in FIG. 8, the wrenches 115 engage the posts 113, this connects the telescoping booms 136 to CT injector 116. Because of the position of piston/cylinder combinations 146, this operatively connects CT injector 116 to the piston/cylinder combinations 146. Since there is no relative rotation between the posts 113 and the wrenches 115, and the posts 113 are fixed to CT injector 116, movement of the piston of the cylinder combinations 146 will rotate the CT injector to the proper orientation once it has been moved into mast 148 as shown in FIG. 9. Thus, as shown in FIG. 9, the cylinders 146 have been extended. In other words, because the latching mechanism comprised of posts 113 and wrenches 115 rotate CT injector 116 when the pistons of cylinders 146 are extended as shown in FIG. 9, CT injector 116 can be properly aligned.

Carrier 130 also includes a mast 148 which, as in the case of mast 82 will generally comprise two spaced columns 150 only one of which is shown. It will be understood that mast 148, while shown as generally vertically aligned in FIG. 7 can be of the type where it can be moved from a vertical position to a horizontal position for transportation purposes, i.e., when carrier 130 is being moved from one site to another site. Indeed, this is generally the case with respect to both masts 82 and 148. Movably, e.g., slidably carried in mast 148 is a top drive 152 which is suspended in the well known manner and as described above with the embodiment shown in FIGS. 1-6 from a crown block assembly which in turn is attached to a drawworks (not shown). The top drive rig comprised of mast 148 is provided with rails or tracks (not shown) attached to and running longitudinally along the columns 150, the rails or tracks serving as a guide for top drive 152 as it is moved longitudinally along mast 148. In the embodiment shown in FIG. 7, it can be seen that carrier 100 is approaching carrier 130. In this position, it will be appreciated that top drive 152 can be performing jointed pipe operation, e.g., tripping pipe into and out of the wellbore below wellhead 134. It will also be appreciated, while not shown, that carrier 130 as well as carrier 70 could be provided with a rotary table or other such apparatus well known to those skilled in the art to aid in the make-up and breakout of threaded, jointed connections.

Figure 8:
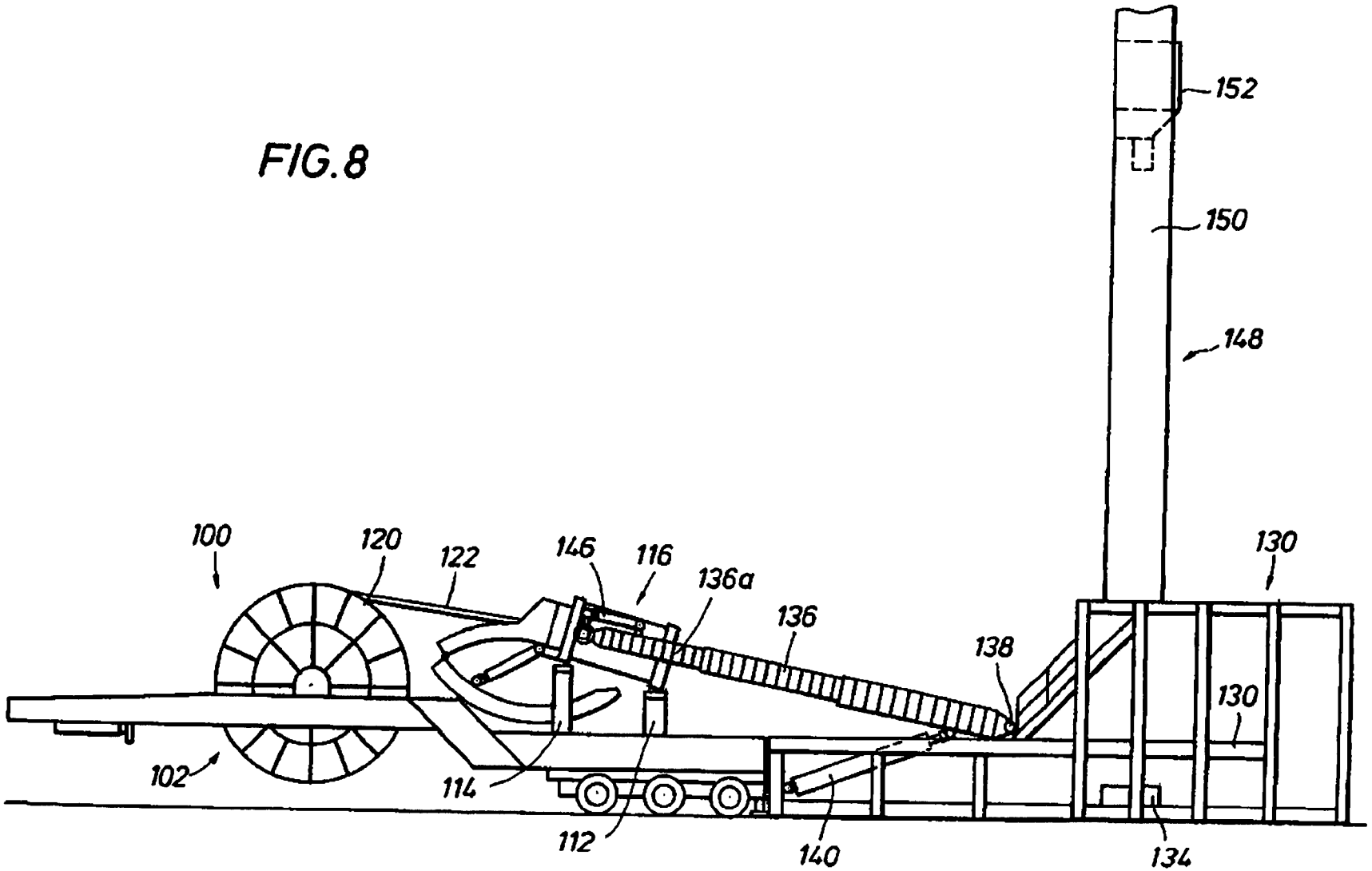
FIG. 8 is a view similar to FIG. 7 but showing the lifter arms on the top drive rig engaging the CT injector on the CT system.
Figure 9:
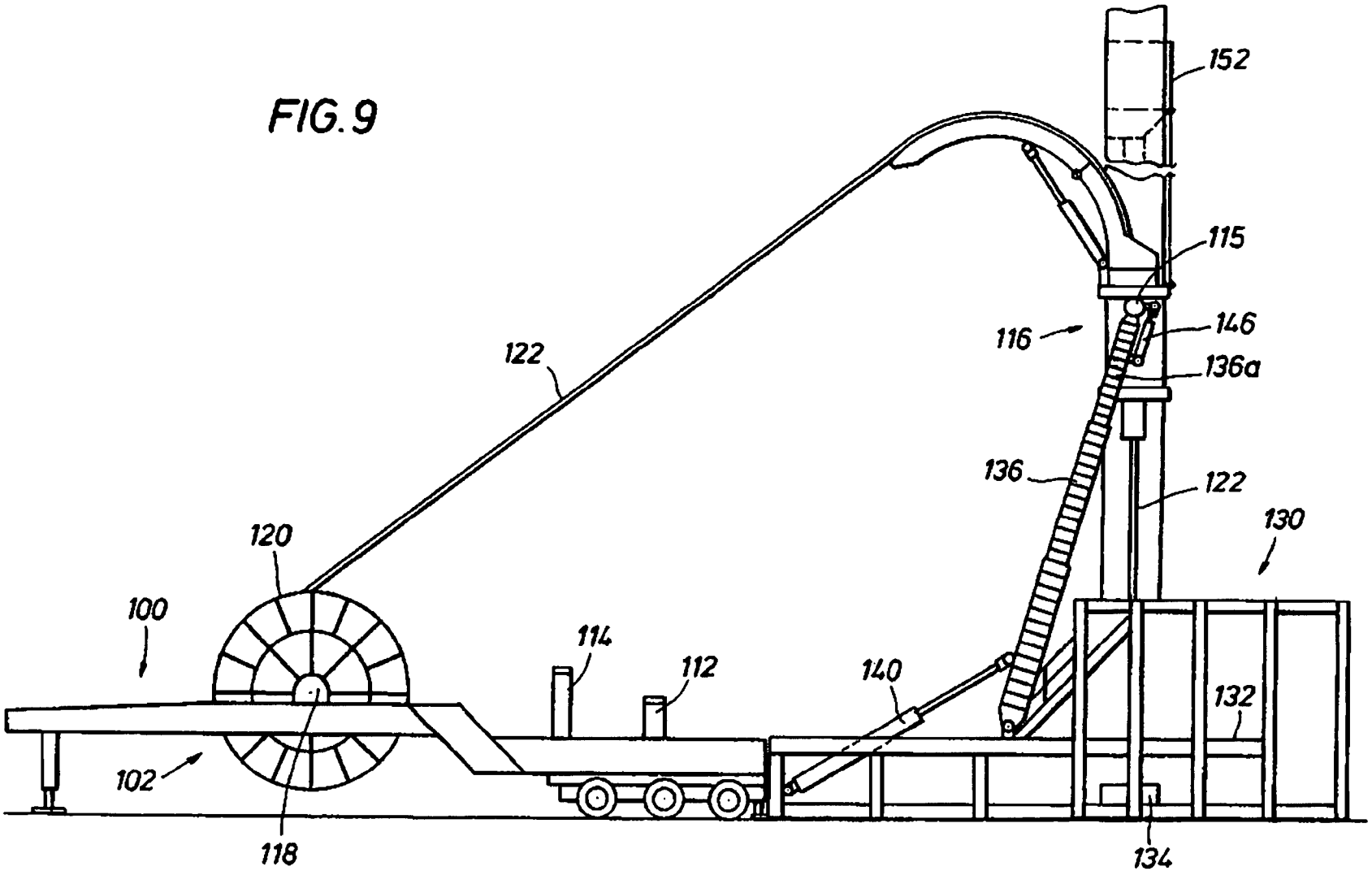
FIG. 9 is a view similar to FIG. 8 but showing the CT injector moved to a position on the top drive rig to perform CT operations.

Turning now to FIG. 8, it can be seen that the CT system 100 and more specifically carrier 102 has been moved such that it generally abuts carrier 130. Further it can be seen that the telescoping booms 136 have been raised by cylinders 140 and extended such that the sections 136*a* of telescoping booms 136 have positioned wrenches 115 into a position where they can grab the posts 113 of CT injector 116.

Turning now to FIG. 9, it can be seen that piston/cylinder combinations 140 have been extended so as to move telescopic booms 136 to the position shown in FIG. 9, i.e., such that CT injector 116 is now substantially in line with top drive 152 and positioned between the columns forming mast 148. In this regard it will also be appreciated that the telescoping sections of boom 136 have been extended so as to properly position CT injector 116. As in the case of the embodiment shown in FIGS. 1-6, when CT injector 116 has been positioned in mast 148 as shown in FIG. 9 and has been suspended from top drive 152 by cables 153, fork members or the like such as fork members 46 and 48 can engage the rails (not shown) on the columns forming mast 148, and CT injector 116 can be suspended from top drive 152. Thus, and as shown in FIG. 9, CT injector 116 is in the position to perform CT operations by injecting CT 122 through wellhead 134 into the wellbore therebelow.

In the embodiments shown in FIGS. 4 and 9, the lifters, e.g., telescopic booms 26, 28 of the embodiment shown in FIG. 4 and telescopic booms 136 of the embodiment shown in FIG. 9, are seen as connected to CT injectors 18 and 116 when the CT injector are positioned over the wellheads, e.g., 74 and 134, respectively. In the embodiments described above, it will be appreciated that at least a portion, usually all, of the weight of the CT injectors 18 and 116 as well as at least a portion, usually all, of the weight of the CT in the wellbore is being carried by the masts 82 and 148, respectively, as transferred through the top drives 92 and 152, respectively. Thus, the telescopic booms could be disconnected from the CT injectors and moved away from the masts if desired. However, since it is rarely, if ever, necessary to move the CT injectors longitudinally along the masts when performing CT operations, the CT injectors can remain connected to the telescoping booms. It should also be noted that the telescoping booms can be used, together with the cables from the top drive to some extent, position the CT injectors at the desired longitudinal positions in the masts. In any event, FIG. 9 depicts a position wherein CT injector 116 is in a position to inject or remove CT 122 into or out of the wellbore below wellhead 134.

Figure 10:
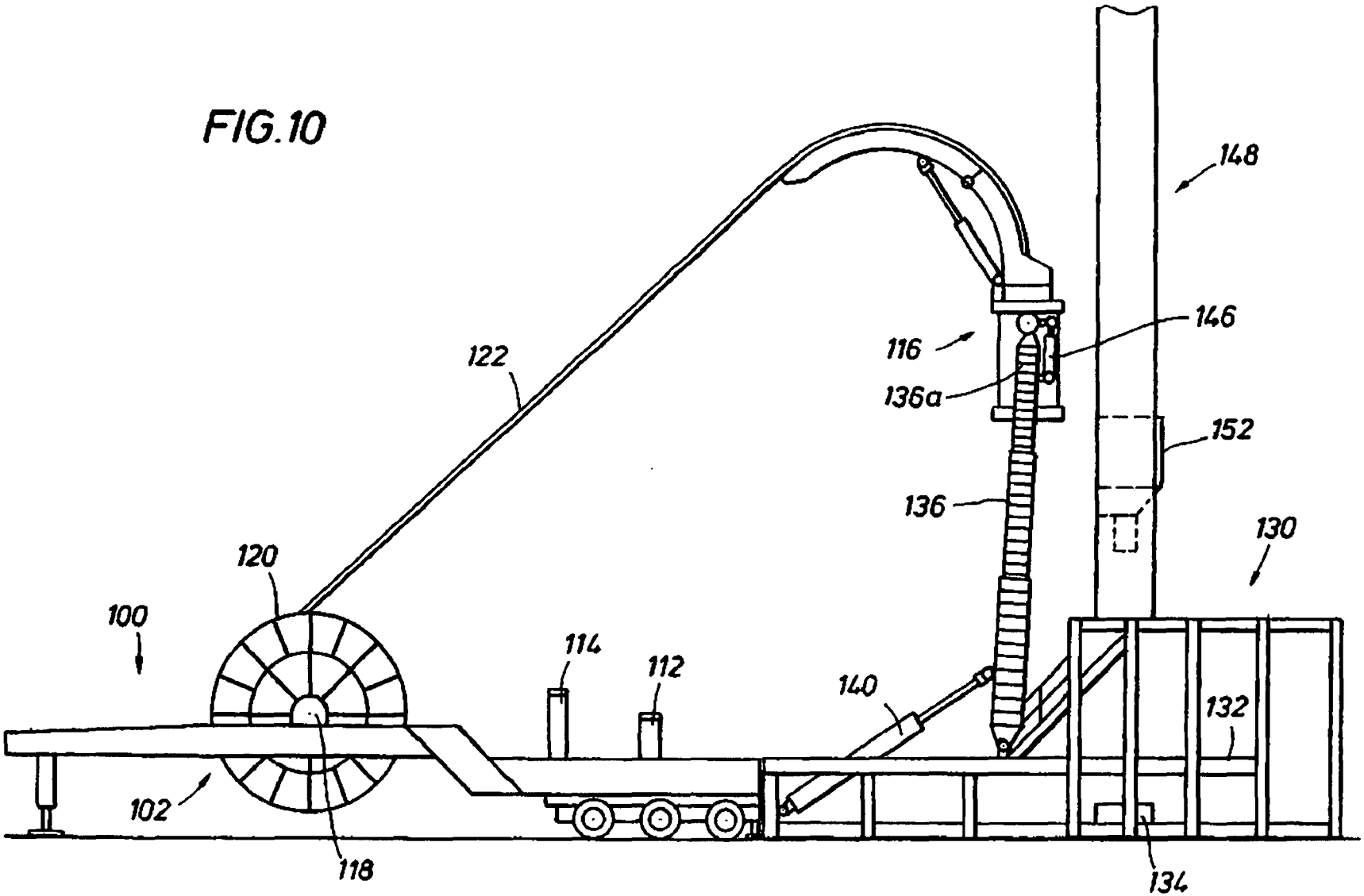
FIG. 10 is a view similar to FIG. 9 but showing the CT injector being moved from the position shown in FIG. 9 to a position wherein top drive operations can be performed by the top drive rig.

Turning now to FIG. 10, there is shown a condition wherein CT injector 116 via appropriate, relative movement of telescopic booms 136 and piston/cylinder combinations 140 has been moved from an operative position, i.e., wherein CT injector can inject CT 122 as shown in FIG. 9, to a position laterally displaced from mast 148. This permits top drive 152 to perform jointed pipe operations without any interference from CT injector 116.

It will be understood that in using the method and apparatus of the present invention and when the earth borehole operations comprise drilling, the CT could be connected to a bottom hole assembly (BHA) which could comprise a drill bit, a downhole motor or other steering device, drill collars, sensors, etc. The use of bottomhole assemblies in CT drilling operations is well known to those skilled in the art.

While the lifter has been described above in conjunction with the use of telescopic booms on at least one of the carriers, it is apparent that both of the carriers could be equipped with telescopic booms or other such lifting devices which could move the CT tubing injector off of the first carrier and into an operative or waiting position relative to the top drive rig. It will also be appreciated that when booms are employed, they need not be telescopic, i.e., they could be a unitary elongate member which was of a desired length such that when the CT injector was moved into the operative position, it would be properly positioned in the mast for CT operations. Although not shown, it is well known that CT injectors are commonly used with lubricators, particularly if workover or other operations are being conducted and the well is under pressure. In this case, the wellhead would customarily include a blowout preventer and other typical wellhead equipment.

The lifter need not comprise booms or other such lifting devices mounted on either carrier. Rather, the carrier could comprise a separate crane, e.g., a jib crane, which could be used to lift the CT injector off of the first carrier and move it into its operative or near operative position with respect to the top drive rig.

While in the embodiments discussed above the CT injector has been described as being suspended from the top drive, it will be appreciated that, rather than being suspended from the top drive, the CT injector could be suspended from the mast, such that the weight of the CT injector and any CT injected into the wellbore is transferred directly to the mast rather than being transferred through the top drive to the mast. The suspension of the CT injector from the mast can be accomplished by any number of techniques which will be readily appreciated by those skilled in the art. For example, referring to FIG. 14 there is shown one assembly for suspending the CT injector from the mast. It will be seen that the assembly shown in FIG. 14 is substantially as that shown in FIG. 5. However, in the case of the embodiment shown in FIG. 14, the tines 58*a* and 60*a* have registering holes which in turn are in register with a hole through rail 90 such that a pin 91 can be received through the registering holes in the tines 58, 60 and in rail 90. In like fashion, a pin 89 is received in registering holes in tines 52*a*, 54*a* and rail 88. It will be appreciated that the pins can be mechanically or manually inserted, or inserted using a hydraulic system, etc. Additionally, provision could be made to provide sockets in the rails 88 and 90 which could be engaged by manually or hydraulically actuated rods which would move from a first position out of engagement with the bores in the rails 88 and 90 to a second position where they were extended laterally outwardly from CT injector 18 and received in the bores in the rails 88 and 90. It will also be understood that preferably the rods and the bores would be non-circular such that any torsional movement of the CT injector 18 as described above would be precluded. Thus it will be appreciated that many techniques can be used to suspend the CT injector from the mast as opposed to suspending it from the top drive.

Figure 11:
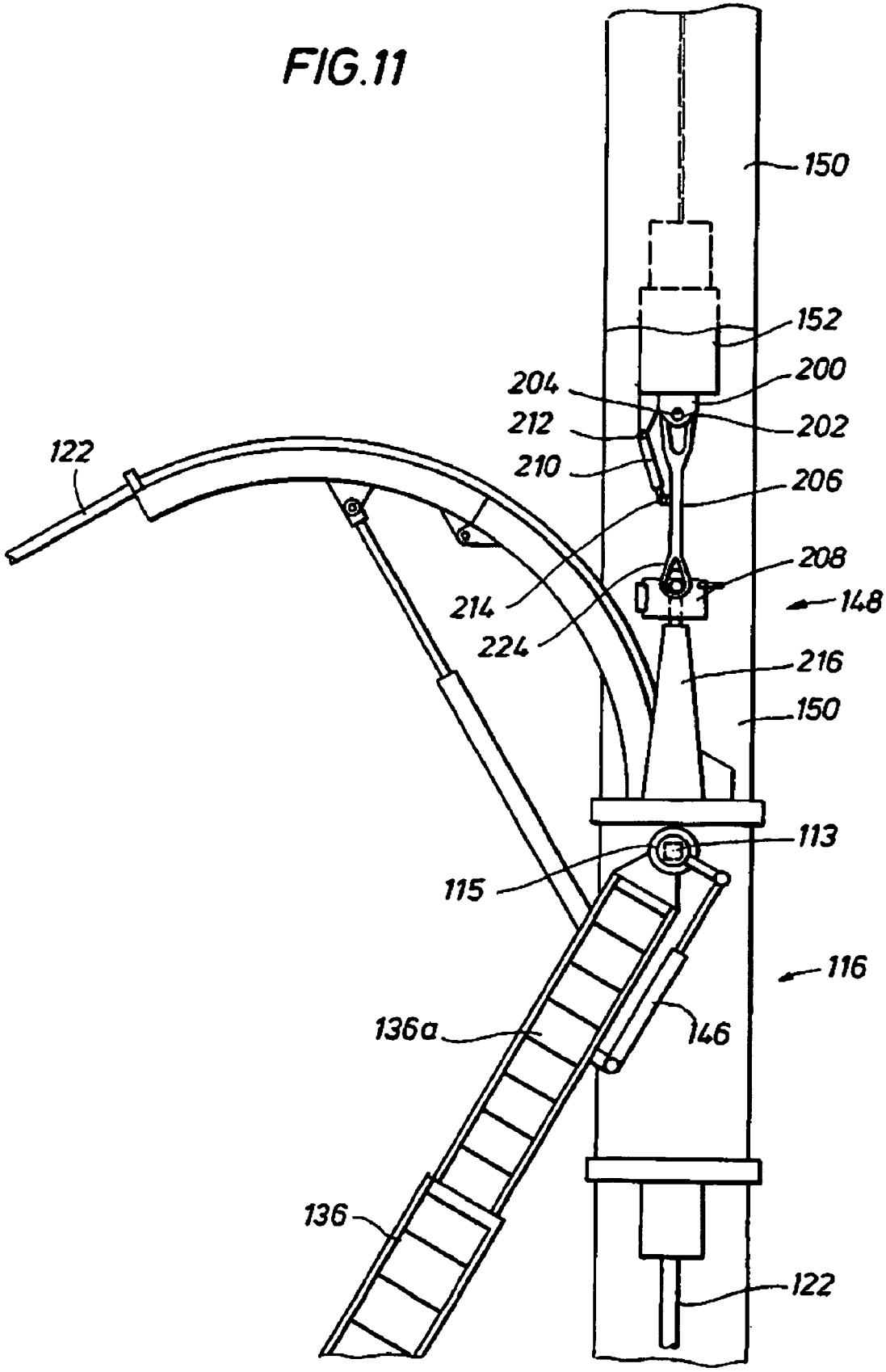
FIG. 11 is an enlarged elevational view showing one method of suspending the CT injector from the top drive.

In the embodiments described above, and when the CT injector was suspended from the top drive, cables were employed that ran between the top drive and the CT injector and which suspended the CT injector from the top drive. A more convenient technique for suspending the CT injector from the top drive, is shown in FIGS. 11-13. For purposes of the following description, it is assumed that the CT injector is CT injector 116 as depicted, for example, in FIG. 7. Turning then to FIG. 11, the CT injector 116 is shown as being positioned in the mast 148, i.e., in line with the top drive 152. Attached to the bottom of top drive 152 are a pair of spaced brackets 200, only one of which is shown. Brackets 200 have registering holes 202 through which extends a shaft 204. Pivotally suspended from shaft 204 are a pair of bails 206 only one of which is shown. Attached to the lower end of the bails 206 is an elevator 208 of a type well known to those skilled in the art.

Also pivotally attached to top drive 152 at 212 is a piston/cylinder combination 210. Piston/cylinder combination is also pivotally attached to the bails 206 as at 214. Attached to the top of CT 116 are spaced stanchions 216 and 218. A cross bar 220 is connected between stanchions 216 and 218. Attached to and extending upwardly from cross bar 220 is a hanger rod 222 on top of which is attached a knob 224. Knob 224 as seen in FIG. 13, having a larger lateral dimension than hanger rod 222. It will be appreciated that hanger rod 222, knob 224, cross bar 220 and stanchions 216 and 218 form a generally rigid structure which is also rigidly attached to CT injector 116.

Elevator 208 is of the clam shell variety having two hinged halves which can be manually or hydraulically opened and closed. In FIG. 11, elevator 208 is shown as being closed around hanger rod 222 such that knob 224 extends above elevator 208. In this regard it will be noted that when elevator 208 is closed around hanger rod 222, it can support CT injector 116. It should be observed that elevator 208 is of the conventional type typically used to grab drill pipe or collared casing out of the V-door to make up a string of jointed pipe. In any event, with elevator 208 closed as shown in FIG. 11, CT injector 116 is now suspended from top drive 152 via bails 206.

FIG. 12 is a view similar to FIG. 11 but shows the elevator 208 disengaged from hanger rod 222. In this regard it will be noted the piston/cylinder combination 210 has been extended so as to move bails 206 and hence elevator 208 out of engagement with hanger rod 222. In this position, elevator 208 would be in the open position. To engage hanger rod 222, piston/cylinder combination 210 is now retracted as shown in FIG. 11 which moves bails 206 and hence elevator 208 into engagement with hanger rod 222.

The foregoing description and examples illustrate selected embodiments of the present invention. In light thereof, variations and modifications will be suggested to one skilled in the art, all of which are in the spirit and purview of this invention.

What is claimed is:

1. An apparatus for conducting earth borehole operations comprising:

a coiled tubing (CT) system comprising a first carrier, a CT injector and a reel of CT;

a second carrier, separate from said first carrier;

a mast mounted on said second carrier;

a top drive carried by said mast for longitudinal movement therealong;

a lifter, said lifter being operative to engage said CT injector and move said CT injector from said first carrier to a position wherein said CT injector is in line with said top drive;

a suspending assembly for suspending said CT injector from said top drive, said suspending assembly including a hanger attached to and extending downwardly from said top drive, a stanchion extending upwardly from said CT injector, said stanchion having a lifting formation, said hanger being selectively engageable with said lifting formation whereby said CT injector can be moved longitudinally along said mast in response to movement of said top drive longitudinally along said mast.

2. The apparatus of claim 1, wherein said hanger comprises bails secured to said top drive on one end and having an elevator on the other end distal said top drive.

3. The apparatus of claim 2, wherein said bails are pivotally secured to said top drive.

4. The apparatus of claim 3, further comprising:

a piston cylinder arrangement for selectively pivoting said bails.

5. The apparatus of claim 1, wherein said lifting formation comprises a lifting knob engageable by said elevator.

6. The apparatus of claim 5, wherein said lifting formation further comprises a frame attached to said CT injector, said lifting knob extending upwardly from said frame.

7. An apparatus for conducting earth borehole operations comprising:

a coiled tubing (CT) system comprising a first carrier, a CT injector and a reel of CT;

a second carrier, separate from said first carrier;

a mast mounted on said second carrier;

a top drive carried by said mast for longitudinal movement therealong;

a lifter, said lifter being operative to engage said CT injector and move said CT injector from said first carrier to a position wherein said CT injector is in line with said top drive;

said CT injector including a guide for guiding the CT from said CT reel into said CT injector, said guide comprising first and second, hingedly secured sections.

8. The apparatus of claim 7, wherein said first section of said guide is securable to said CT injector, said second section of said guide being movable from a first position when said CT injector is on said first carrier to a second position when said CT injector is lifted off said first carrier.

9. The apparatus of claim 7, wherein said second section of said guide is moved to said second position by a piston-cylinder arrangement.

* * * * *